US012798838B2

(12) United States Patent
Zaccaria

(10) Patent No.: US 12,798,838 B2
(45) Date of Patent: Nov. 17, 2026

(54) CLOSURE CAP FOR BOTTLES CONTAINING LIQUIDS UNDER PRESSURE

(71) Applicant: PE.DI S.R.L., Ivrea (IT)

(72) Inventor: Matteo Zaccaria, Salussola (IT)

(73) Assignee: PE.DI S.R.L., Ivrea (IT)

( * ) Notice: Subject to any disclaimer, the term of this patent is extended or adjusted under 35 U.S.C. 154(b) by 35 days.

(21) Appl. No.: 19/028,263

(22) Filed: Jan. 17, 2025

(65) Prior Publication Data

US 2025/0282528 A1 Sep. 11, 2025

(30) Foreign Application Priority Data

Mar. 11, 2024 (IT) ..... 102024000005323

(51) Int. Cl.
*B65D 41/44* (2006.01)
*B65D 53/04* (2006.01)

(52) U.S. Cl.
CPC ..... *B65D 41/44* (2013.01); *B65D 53/04* (2013.01); *B65D 2251/0015* (2013.01); *B65D 2251/0093* (2013.01)

(58) Field of Classification Search
CPC .... B65D 2251/0015; B65D 2251/0093; B65D 41/32; B65D 41/44; B65D 41/445; B65D 51/1661; B65D 53/04
USPC ..... 215/250, 253, 254, 255, 256; 220/257.2, 220/258.5, 265, 270, 266
See application file for complete search history.

(56) References Cited

U.S. PATENT DOCUMENTS 4,069,936 A 1/1978 Ota
6,196,408 B1 * 3/2001 Setty ..... B65D 3/261 220/276
8,242,915 B2 * 8/2012 Yan ..... B65D 41/485 215/250
8,627,969 B2 * 1/2014 Granger ..... B29C 45/14311 220/276

(Continued)

FOREIGN PATENT DOCUMENTS

FR 1396006 A 4/1965
JP 6683506 B2 * 4/2020

(Continued)

OTHER PUBLICATIONS

Search Report from Corresponding Italian Patent Application No. 102024000005323, dated Sep. 18, 2024.

*Primary Examiner* — James N Smalley
*Assistant Examiner* — Madison L Poos
(74) *Attorney, Agent, or Firm* — Cooper Legal Group LLC

(57) ABSTRACT

A closure cap having a hollow cylindrical body. The body includes a capsule-shaped cap portion and an open annular band, which is made integral in a breakable way with the cap portion by a breakable circumferential edge having a narrow thickness. At least one flexible tab is attached to the annular band such that the annular band can be removed by pulling the tab to break the breakable circumferential edge. At least one deformable annular protrusion having an external diameter which is greater than the external average diameter of the cylindrical body is on the side surface of the cap portion. The annular protrusion is configured to deform when a pressure higher than a predefined pressure threshold value is reached inside the cylindrical body. The closing wall is configured to rise following the deformation of the annular protrusion.

15 Claims, 4 Drawing Sheets

(56) References Cited

U.S. PATENT DOCUMENTS

| | | | | |
|---|---|---|---|---|
| 10,548,347 | B2 * | 2/2020 | Playford | B65D 77/32 |
| 2007/0023383 | A1 * | 2/2007 | Perrin | B65D 41/485 215/257 |
| 2012/0055899 | A1 * | 3/2012 | Parmaningsih | B65D 41/485 215/255 |
| 2014/0263155 | A1 * | 9/2014 | Szczesniak | B65D 79/0087 215/252 |

FOREIGN PATENT DOCUMENTS

| | | | |
|---|---|---|---|
| WO | 2011142092 | A1 | 11/2011 |
| WO | 2019238612 | A1 | 12/2019 |

* cited by examiner

CLOSURE CAP FOR BOTTLES CONTAINING LIQUIDS UNDER PRESSURE

CROSS-REFERENCE TO RELATED APPLICATION(S)

This application claims priority under 35 U.S.C. § 119 to: Italian Patent Application No.: 102024000005323, filed on 11 Mar. 2024, which is herein incorporated by reference.

BACKGROUND

The present invention generally relates to a closure cap for bottles and, in particular, a cap with a tamper-proof seal for bottles containing liquids under pressure.

Closure caps for bottles which comprise a tamper-proof seal are known. These closure caps are of the capsule type and are usually made of aluminium alloy. The tamper-proof seal is obtained on the cylindrical side surface of the cap. In other words, an annular band which is connected to the remaining capsule portion of the cap by means of a notch or a non-through cut and is provided with a grip tab for the user is obtained on the cylindrical side surface of the cap. The notch allows the material from which the cap is made to be sufficiently weak to be torn, making it easy to open the cap after the separation of the annular band and the remaining capsule portion of the cap. The irreversible tearing of the annular band with respect to the remaining capsule portion of the cap makes it visually evident that the bottle has been opened for the first time. A known type of closure cap for bottles, which comprises a tamper-proof seal, is illustrated for example in U.S. Pat. No. 4,069,936 A.

The most correct way to remove the tamper-proof seal, or annular band, is explained below. The user firmly grasps the bottle and places his or her thumb on the capsule portion of the closure cap. Meanwhile, with the other hand, he or she grabs the tab and takes it between his or her thumb and forefinger and pulls it to tear the notch of the annular band by about ⅓ of its diameter. At this stage, the capsule portion of the closure cap can be removed by lifting it from the mouth of the bottle.

The closure caps with a tamper-proof seal of the type described above are mainly used in the Ho.Re.Ca. and on-trade market. These closure caps are used, for example, to close bottles containing mineral water. However, a drawback of the closure caps with a tamper-proof seal is that they are not designed to close bottles containing liquids under pressure. A company that uses these closure caps is therefore forced to purchase several different closure caps to package bottles containing different liquids, both pressurized and non-pressurized.

In a closure cap with a tamper-proof seal of the type described above, the liquid is ensured to be kept in the bottle by the contact of the mouth of the bottle and a synthetic gasket inserted inside the capsule portion of the closure cap. If this closure cap is used to close a bottle inside which a pressure higher than the atmospheric pressure is generated, this cap shall not be able to retain the pressurized gas inside the bottle. Furthermore, when a certain pressure threshold, typically equal to 8 bars, is exceeded the notch for weakening the tamper-proof band can break, causing the cap to explode.

SUMMARY

The object of the present invention is, therefore, to provide a closure cap for bottles containing liquids under pressure which is capable of solving the aforementioned drawbacks of the prior art in an extremely simple, economical and particularly functional way.

In detail, it is an object of the present invention to provide a closure cap for bottles which is capable of sealing bottles containing liquids under pressure, that is to say at a pressure which is greater than the atmospheric pressure, for example liquids with a maximum carbonation equal to 3.6% v/v (volume of solute/volume of solution) of $CO_2$.

Another object of the present invention is to provide a closure cap for bottles which is capable of safely closing bottles containing liquids under pressure, this closure cap being actually equipped with an anti-explosion system.

These objects according to the present invention will be achieved by providing a closure cap for bottles containing liquids under pressure, as well as a method for manufacturing a closure cap for bottles containing liquids under pressure, as set forth in the independent claims.

Further features of the invention are highlighted by the dependent claims, which are an integral part of the present description.

According to the invention, the closure cap is provided with a substantially cylindrical capsule portion, made of aluminium alloy. The cap portion is internally provided with a gasket, which is manufactured with an elastomer-thermoplastic material, in order to contain the liquids at a pressure not exceeding a predefined pressure threshold value, for example equal to 3.6% v/v of $CO_2$. The capsule portion is also shaped in such a way as to prevent the bursting of the closure cap if pressures exceeding the predefined pressure threshold value are reached. The closure cap is also provided with a circumferential notch designed to weaken the aluminium wall, in order to separate the capsule portion from a breakable annular band. A tear-off tab made of plastic material, for example made of polyester TNT, is fastened in a suitable seat on the annular band. The annular band, with its respective tear-off tab, makes the tamper-proof seal of the closure cap.

BRIEF DESCRIPTION OF THE DRAWINGS

The features and advantages of a closure cap for bottles containing liquids under pressure according to the present invention will be clearer from the following exemplifying and hence non-limiting description, referring to the attached schematic drawings in which.

DETAILED DESCRIPTION

Figure 1:
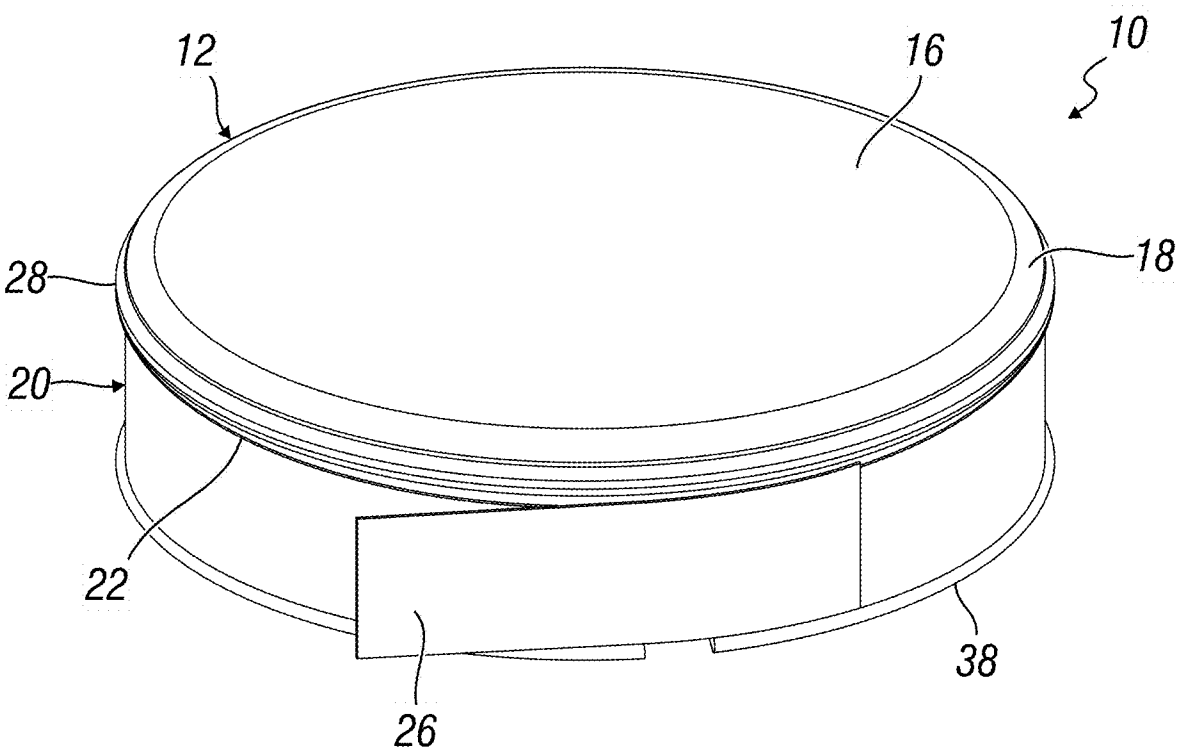
FIG. 1 is a top axonometric view of a preferred embodiment of the closure cap for bottles containing liquids under pressure according to the present invention.
Figure 2:
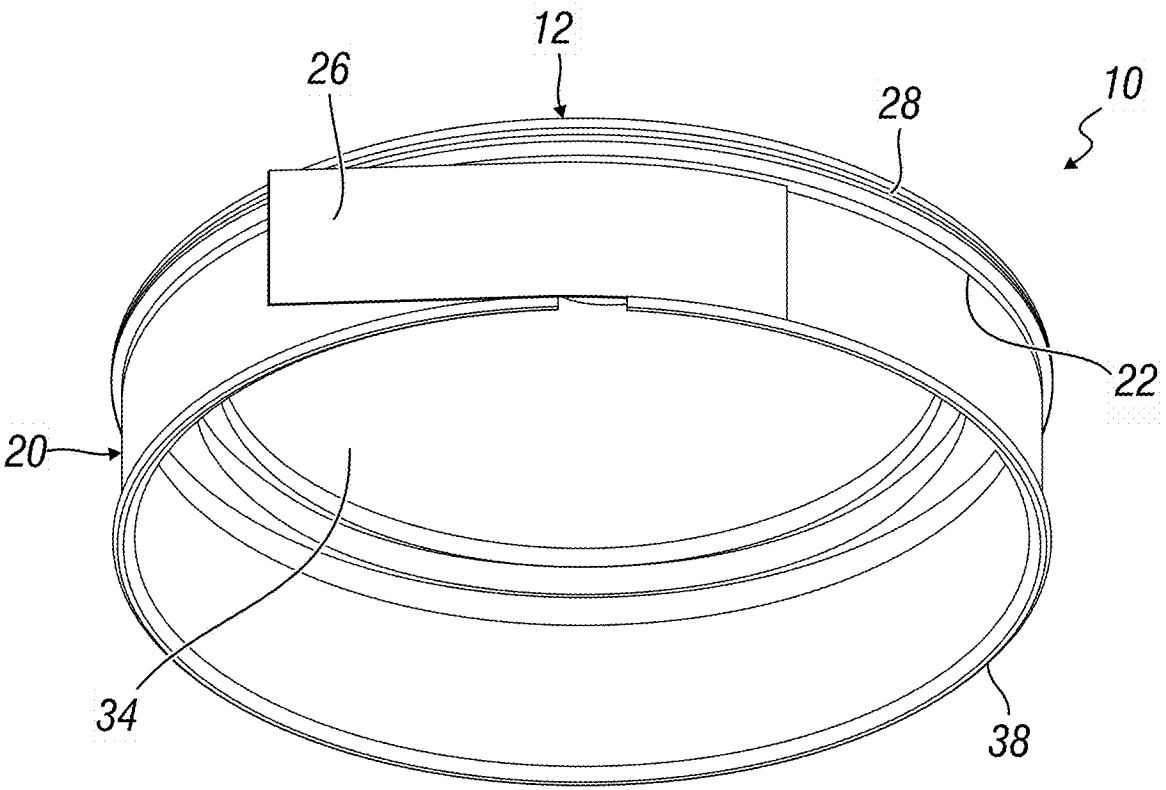
FIG. 2 is a bottom axonometric view of the cap in FIG. 1.
Figure 3:
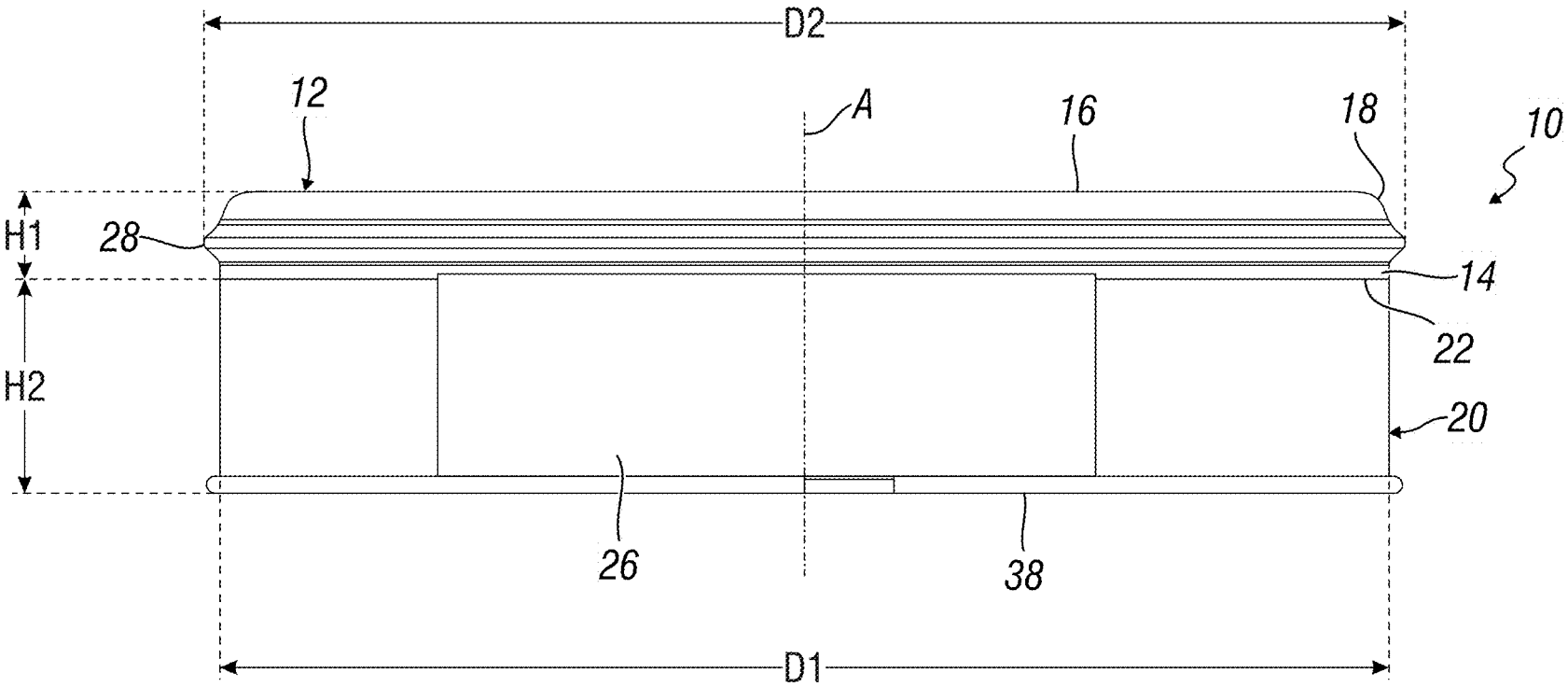
FIG. 3 is a side elevation view of the cap in FIG. 1.
Figure 5:
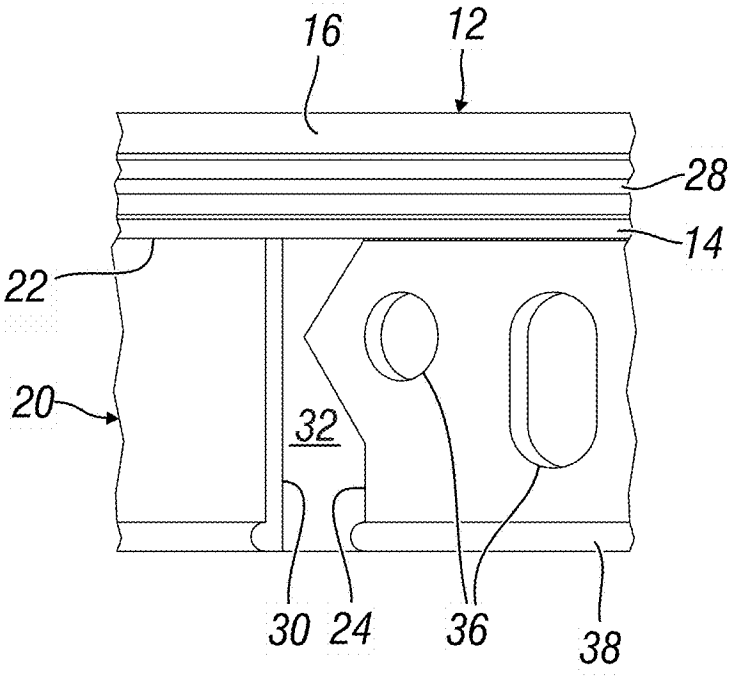
FIG. 5 is another enlarged view showing another detail of the cap in FIG. 1.
Figure 4:
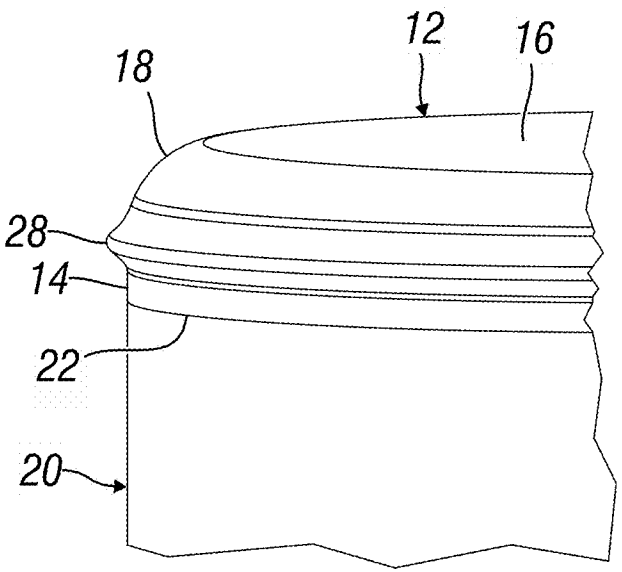
FIG. 4 is an enlarged view showing a detail of the cap in FIG. 1.

With reference to the figures, a closure cap for bottles containing liquids under pressure according to the present invention is shown. The closure cap is indicated as a whole with reference number 10. The closure cap 10 is intended for use on bottles containing liquids under pressure, preferably food liquids, such as beer, sparkling water or carbonated soft drinks.

The closure cap 10 consists of a hollow cylindrical body which extends around a longitudinal axis A and has a circular cross-section having a predefined external average diameter D1. The cylindrical is manufactured starting from a sheet of metal material having a predefined average thickness and comprises primarily a capsule-shaped cap portion 12, which forms the head of the closure cap 10. The cap portion 12 is provided with a cylindrical side surface 14 and a flat circular closing wall 16. The closing wall 16 of the cap portion 12 is obtained at a head end 18 of the cylindrical body. The side surface 14 of the cap portion 12 has an external average diameter which is substantially coincident with the predefined external average diameter D1 of the cylindrical body and has a predefined total height H1, measured along the longitudinal axis A.

The cylindrical body further comprises an open or C-shaped annular band 20, which is manufactured with the same sheet of metal material having a predefined average thickness the cylindrical body is manufactured with. The open or C-shaped annular band 20 is made integral in a breakable way with the side surface 14 of the cap portion 12 by means of a breakable circumferential edge 22. This breakable circumferential edge 22 has a thickness which is lower than the predefined average thickness the cylindrical body is manufactured with. The open or C-shaped annular band 20 has an external average diameter which is substantially coincident with the predefined external average diameter D1 and has a total height H2 which is greater than the total height H1 of the side surface 14 of the cap portion 12.

At least one flexible tab 26 is attached to a first open end 24 of the open or C-shaped annular band 20 in such a way that a user of the closure cap 10 can obtain, by pulling this tab 26, the removal of the open or C-shaped annular band 20 by breaking the breakable circumferential edge 22. The irreversible separation of the cap portion 12 and the open or C-shaped annular band 20 is thereby obtained, making the closure cap 10 first opening visible. The presence of the removable annular band 20 therefore gives the closure cap 10 the characteristic of being "tamper evident", that is to say it has been evidently tampered.

According to the invention, at least one deformable annular protrusion 28 having an external diameter D2 which is greater than the predefined external average diameter D1 of the cylindrical body is obtained on the side surface 14 of the cap portion 12, at the breakable circumferential edge 22. The annular protrusion 28 is configured to deform when a pressure higher than a predefined pressure threshold value is reached inside the cylindrical body. The closing wall 16 of the cap portion 12 is thereby configured to rise following the deformation of the annular protrusion 28, obtaining an elongation of the cap portion 12 in the direction of the longitudinal axis A. In other words, the total height H1 of the side surface 14 of the cap portion 12 increases as a result of the deformation of the annular protuberance 28.

The annular protuberance 28, which is adjacent to the breakable circumferential edge 22 of the "tamper evident" annular band 20, therefore forms an anti-explosion system for the closure cap 10. When the closure cap 10 is in its operating condition, that is to say in the closed position on the mouth of a bottle, the annular protuberance 28 acts by accumulating mechanical energy through its deformation under the effect of the thrust received from inside the bottle, by the liquid under pressure. When the predefined pressure threshold value which may be for example equal to 8 bars, is exceeded, the annular protuberance 28 stretches completely, raising the upper closing wall 16 of the cap portion 12.

Advantageously, the first open end 24 of the open or C-shaped annular band 20 and a second open end 30 of such open or C-shaped annular band delimit a through lateral opening 32 through which a pressurized gas can escape when the predefined pressure threshold value is exceeded. The raising of the upper closing wall 16 of the cap portion 12 thus provides the possibility for excess gas to escape through this lateral through opening 32, preventing the bursting of the closure cap 10. This allows the breakable circumferential edge 22 to remain free from any stress, as the energy due to the pressure is absorbed by the deformation of the annular 10 protuberance 28. When the annular protuberance 28 is completely stretched, the height of the cap portion 12 is increased to such an extent that excess the gas escapes through the lateral through opening 32.

Preferably, the cap portion 12 is internally provided with at least one sealing gasket 34, which is manufactured with an elastomer-thermoplastic material (TPE) and is placed below its closing wall 16. Again, preferably, this sealing gasket 34 is a disc-shaped seal. The gasket of the type thermoformed in an elastomer-thermoplastic material guarantees that the bottle is correctly closed, and the liquid is kept under pressure.

Preferably, the predefined average thickness of the metal material the cylindrical body of the closure cap 10 is manufactured with is between about 200 microns and about 250 microns. Again, preferably, the metal material the cylindrical body of the closure cap 10 is manufactured with is an aluminium alloy, for example aluminium alloy 8011 or other alloys with a similar composition.

Conversely, the flexible tab 26 can be manufactured with a non-metallic material, such as a non-woven polyester fabric. At least one through hole 36 can then be obtained on the first open end 24 of the open or C-shaped annular band 20 for fastening the flexible tab 26, for example by ultrasonic welding or similar techniques.

The method for manufacturing the closure cap 10 described so far comprises the following sequential steps. First of all, a sheet of metal material having a predefined average thickness, for example between 200 microns and 250 microns, is prepared. As mentioned above, the metal material can be for example the aluminium alloy 8011. A heat treatment on the sheet of metal material, such as a H14 or H16 or similar heat treatment, and then the painting of the sheet of metal material with enamels, paints or inks are carried out.

The aluminium sheet then undergoes a light drawing and shearing process, obtaining a cylindrical body having a closed base formed by the closing wall 16 of the cap portion 12. After being formed, the cylindrical body undergoes one or more mechanical processing steps, during which it is obtained what follows:

- a non-through cut, which forms the breakable circumferential edge 22,
- at least one rib, which forms the deformable annular protrusion 28, and thereby the anti-burst system, and
- at least one through lateral opening 32, which makes the annular band 20 open or C-shaped and allows the excess gas to escape.

Further optional mechanical processing steps on the cylindrical body can also comprise, in a per se known manner, making additional ribs and/or folds, such as a lower rib on the lower circumferential edge of the open or C-shaped annular band 20.

Once the basic work on the cylindrical body has been completed, the flexible tab 26 is shaped so that it has dimensions compatible with the dimensions of the annular band 20. The shaped flexible tab 26, which is manufactured for example with a non-woven polyester fabric or with materials having similar mechanical resistance, is then attached onto the first open end 24 of the annular band 20, for example by ultrasonic welding or similar techniques.

The method for manufacturing the closure cap 10 can then comprise a final step of applying, by thermoforming, the sealing gasket 34 manufactured with an elastomer-thermoplastic material (TPE), below the closing wall 16 of the cap portion 12. The closure cap 10 thus obtained can be directly placed on the market. Its functionalities are completed later, during the assembly phase on the bottle. In this phase, in fact, the bottling company creates the final package consisting of the bottle, the closure cap 10 and the liquid under pressure contained inside the bottle by using a capping machine with a head suitable for the closure cap 10, as well as a bottle mouth which is compatible with the closure cap 10.

It has thus been seen that the closure cap for bottles containing liquids under pressure according to the present invention achieves the purposes previously highlighted, in particular obtaining the following advantages:

sealing and securely closing bottles containing liquids under pressure, while maintaining the "tamper evident" characteristic; this closure cap for bottles can therefore guarantee the safety and quality conditions for the sealing of sparkling liquids, maintaining all the protection characteristics of the bottled product, whatever its nature (beer, sparkling water, carbonated soft drinks or other) unchanged.

The closure cap for bottles containing liquids under pressure of the present invention thus conceived is however susceptible of numerous modifications and variations, all of which falling within the same inventive concept; furthermore, all the details can be replaced by technically equivalent elements. In practice, the materials used, as well as the shapes and dimensions, may be any according to the technical requirements. The scope of protection of the invention is therefore defined by the attached claims.

The invention claimed is:

1. A closure cap for bottles, the closure cap comprising:

a hollow cylindrical body which extends around a longitudinal axis and has a circular cross-section with a predefined external average diameter, the cylindrical body being made from a sheet of metal material having a predefined average thickness, the cylindrical body comprising:

a capsule-shaped cap portion, which is provided with a cylindrical side surface and a flat circular closing wall, said closing wall being disposed at a head end of the cylindrical body, wherein said side surface has an external average diameter which is substantially coincident with said predefined external average diameter and has a predefined total height, which is measured along said longitudinal axis; and an open or C-shaped annular band made integral in a breakable way with said side surface by a breakable circumferential edge having a thickness narrower than the predefined average thickness of the metal material the cylindrical body is made from, wherein said open or C-shaped annular band has an external average diameter which is substantially coincident with said predefined external average diameter and has a total height which is greater than the total height of said side surface of the cap portion, and wherein at least one flexible tab is attached to a first open end of said open or C-shaped annular band in such a way that the annular band can be removed by pulling the tab to break the breakable circumferential edge, thereby causing an irreversible separation of said cap portion and said open or C-shaped annular band and making a first opening of the closure cap visible;

wherein at least one deformable annular protrusion is on said side surface of the cap portion, at said breakable circumferential edge, said annular protrusion having an external diameter which is greater than said predefined external average diameter, wherein said annular protrusion is configured to deform when a pressure higher than a predefined pressure threshold value is reached inside said cylindrical body while the breakable circumferential edge remains unbroken, and wherein said closing wall is configured to rise following the deformation of said annular protrusion, obtaining an elongation of said cap portion in the direction of said longitudinal axis.

2. The closure cap according to claim 1, wherein the first open end of said open or C-shaped annular band and a second open end of said open or C-shaped annular band delimit a through lateral opening through which a pressurized gas can escape when said predefined pressure threshold value is exceeded.

3. The closure cap according to claim 2, wherein said cap portion is internally provided with at least one sealing gasket, which is manufactured with an elastomer-thermoplastic material, said sealing gasket being placed below the closing wall of said cap portion.

4. The closure cap according to claim 3, wherein said sealing gasket is a disc-shaped seal.

5. The closure cap according to claim 1, wherein the predefined average thickness of the metal material the cylindrical body is made from is between about 200 microns and about 250 microns.

6. The closure cap according to claim 5, wherein said metal material is an aluminium alloy.

7. The closure cap according to claim 6, wherein said flexible tab is made from a non-woven polyester fabric.

8. The closure cap according to claim 7, wherein at least one through hole for fastening said flexible tab is disposed on the first open end of said open or C-shaped annular band.

9. The closure cap according to claim 1, wherein said cap portion is internally provided with at least one sealing gasket, which is manufactured with an elastomer-thermoplastic material, said sealing gasket being placed below the closing wall of said cap portion.

10. The closure cap according to claim 9, wherein said sealing gasket is a disc-shaped seal.

11. The closure cap according to claim 1, wherein said metal material is an aluminium alloy.

12. The closure cap according to claim 1, wherein said flexible tab is made from a non-woven polyester fabric.

13. The closure cap according to claim 1, wherein at least one through hole for fastening said flexible tab is disposed on the first open end of said open or C-shaped annular band.

14. A method for making a closure cap for bottles, comprising:

providing a sheet of metal material having a predefined average thickness;

heat treating said sheet of metal material;

painting said sheet of metal material with enamel, paint or ink;

forming a hollow cylindrical body from the sheet of metal material such that the cylindrical body extends around a longitudinal axis and has a circular cross-section with a predefined external average diameter, the cylindrical body comprising:

a capsule-shaped cap portion, which is provided with a cylindrical side surface and a flat circular closing wall, said closing wall being disposed at a head end of the cylindrical body, wherein said side surface has an external average diameter which is substantially coincident with said predefined external average diameter and has a predefined total height, which is measured along said longitudinal axis; and an open or C-shaped annular band made integral in a breakable way with said side surface by a breakable circumferential edge having a thickness narrower than the predefined average thickness of the metal material the cylindrical body is made from, wherein said open or C-shaped annular band has an external average diameter which is substantially coincident with said predefined external average diameter and has a total height which is greater than the total height of said side surface of the cap portion, and wherein at least one flexible tab is attached to a first open end of said open or C-shaped annular band in such a way that the annular band can be removed by pulling the tab to break the breakable circumferential edge, thereby causing an irreversible separation of said cap portion and said open or C-shaped annular band and making a first opening of the closure cap visible;

wherein at least one deformable annular protrusion is on said side surface of the cap portion, at said breakable circumferential edge, said annular protrusion having an external diameter which is greater than said predefined external average diameter, wherein said annular protrusion is configured to deform when a pressure higher than a predefined pressure threshold value is reached inside said cylindrical body while the breakable circumferential edge remains unbroken, and wherein said closing wall is configured to rise following the deformation of said annular protrusion, obtaining an elongation of said cap portion in the direction of said longitudinal axis;

shaping said at least one flexible tab so that it has dimensions that are compatible with the dimensions of said annular band; and attaching said at least one shaped flexible tab to the first open end of said annular band;

wherein the forming the hollow cylindrical body comprises subjecting the sheet of metal material to a light drawing and shearing process;

wherein the breakable circumferential edge is formed by making a non-through cut in the sheet of metal material;

wherein the deformable annular protrusion is formed by making at least one rib in the sheet of metal material; and wherein the annular band is formed by making at least one through lateral opening in the sheet of metal material to make the annular band open or C-shaped.

15. The method according to claim 14, comprising applying, by thermoforming, at least one sealing gasket made from an elastomer-thermoplastic material below the closing wall of said cap portion.

* * * * *